United States Patent [19]

Williams

[11] 4,063,207

[45] Dec. 13, 1977

[54] COIL STRUCTURE

[75] Inventor: Howard E. Williams, Reseda, Calif.

[73] Assignee: Litton Systems, Inc., Woodland Hills, Calif.

[21] Appl. No.: 764,399

[22] Filed: Jan. 31, 1977

[51] Int. Cl.[2] ..... H01F 27/30

[52] U.S. Cl. ..... 336/171; 335/299; 336/188; 336/207; 336/208

[58] Field of Search ..... 335/213, 299; 336/170, 336/171, 188, 189, 198, 208, 225, 207

[56] References Cited

U.S. PATENT DOCUMENTS

| | | | |
|---|---|---|---|
| 1,558,090 | 10/1925 | Howard | 336/207 |
| 2,058,037 | 10/1936 | Rigandi | 336/171 X |
| 2,399,382 | 4/1946 | Polydoroff | 336/188 X |
| 3,249,858 | 5/1966 | Gouilloud | 336/208 |

*Primary Examiner*—Thomas J. Kozma

*Attorney, Agent, or Firm*—Harold E. Gillmann

[57] ABSTRACT

A cylindrical coil form, for magnetic coupling with an irradiated nuclear magnetic resonance gas sample, is provided with peripheral and longitudinal grooves. The peripheral grooves are not helical in form, but are perpendicular to the axis of the coil form to give a precisely directed longitudinal magnetic field. A first coil for providing strong magnetic coupling along the axis of the coil form is wound in the peripheral grooves, the adjacent turns being interconnected by short longitudinal sections of wire in one of the longitudinal grooves. Additional coils are provided for magnetic coupling transverse to the axis of the coil through the use of wires extending down one of the longitudinal slots and back in another longitudinal slot. The form may be of phenolic material, or may be transparent so that the nuclear magnetic resonance sample may be irradiated directly through the coil form.

13 Claims, 7 Drawing Figures

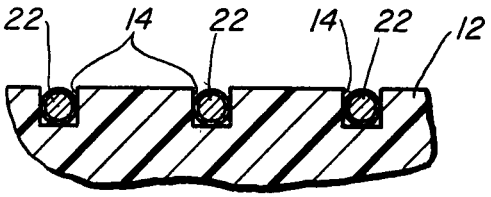
Fig_3
Fig_4
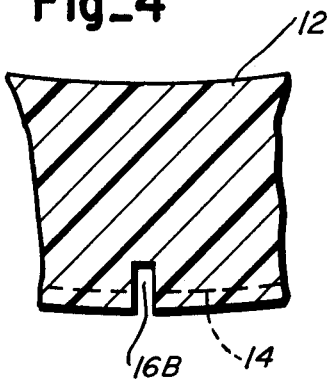
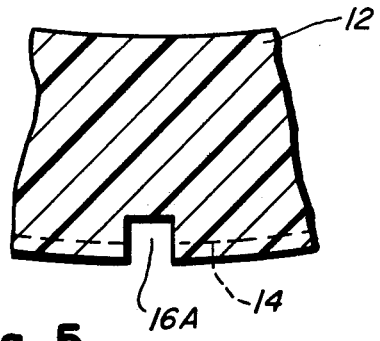
Fig_5
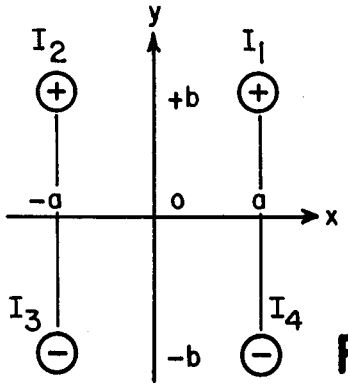
Fig_7
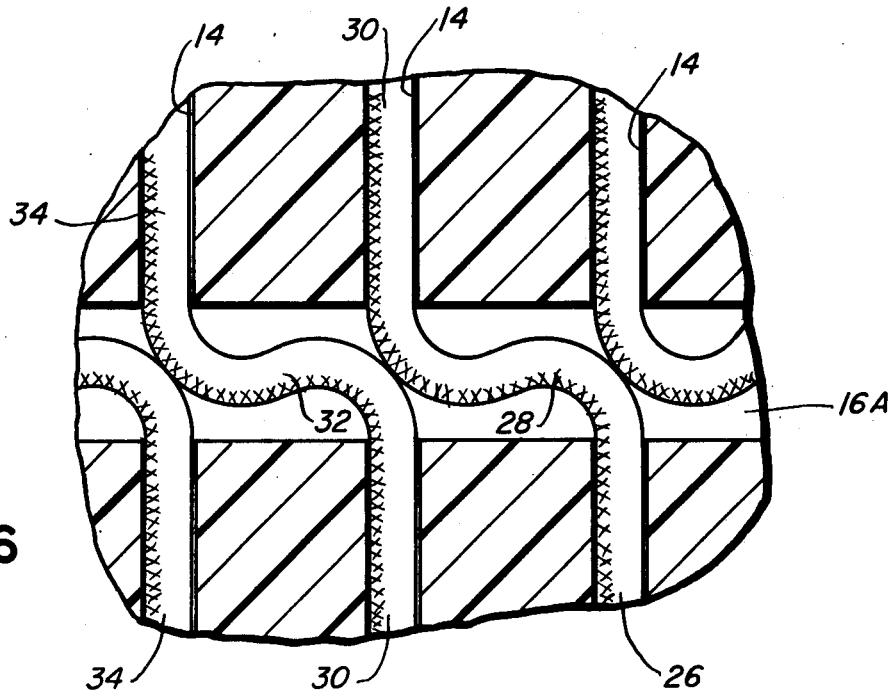
Fig_6

COIL STRUCTURE

FIELD OF THE INVENTION

This invention relates to coil structures, and more particularly to structures for providing coupling at different angles.

BACKGROUND OF THE INVENTION

With regard to structures for supporting coils, many different arrangements have been proposed for inductances and for transformers involving the coupling of the magnetic field produced by one coil into another coil. However, in the case of coil structures in which direct coupling of the magnetic fields does not occur to a significant extent, and where very accurate orientation of the magnetic fields is required, little work has been done. Accordingly, a principal object of the invention is to provide an improved coil structure for accurately orienting magnetic fields in at least two mutually orthogonal directions.

SUMMARY OF THE INVENTION

The present invention contemplates the use of a coil form of cylindrical shape or of another surface of revolution having a longitudinal axis, and having both peripheral grooves and grooves extending along the coil form in the direction of the longitudinal axis. Strong magnetic coupling along the axis of the coil is provided by wires wound in said peripheral grooves, and transverse coupling to the region within the coil form is provided by coils including wires extending down and back along the longitudinal grooves in the coil form.

In accordance with one aspect of the invention, magnetic field responsive material, such as a nuclear magnetic resonance gas sample, may be located within the coil.

In accordance with another feature of the invention two mutually orthongonal magnetic fields may be provided by a pair of coils each including wires extending along the longitudinal grooves in the coil form. The resultant coupling arrangements provide coupling along three mutually orthogonal directions, one of which is the axis of the coil.

Very accurate field orientation along the axis of the coil may be provided through the use of peripheral grooves which are circular in nature and perpendicular to the axis of the coil form. Connection between adjacent turns of the coil is accomplished by running the wire along one of the longitudinal grooves for the brief distance between adjacent turns of the coil.

In accordance with a subordinate feature of the invention, the coil form may be transparent so that material within the coil form may be directly irradiated by pumping illumination, or the like, through the coil form.

Other objects, features, and advantages of the invention will become apparent from a consideration of the following detailed description and from the accompanying drawings.

BRIEF DESCRIPTION OF THE DRAWINGS

FIGS. 3, 4 and 5 are details showing the nature of the peripheral and longitudinal grooves in the outer surface of the coil form;

FIG. 6 is a detail showing the connection of one turn of the coil to the next adjacent turn; and FIG. 7 is a diagram employed in the analysis of the transverse field coil configuration.

DETAILED DESCRIPTION

Figure 1:
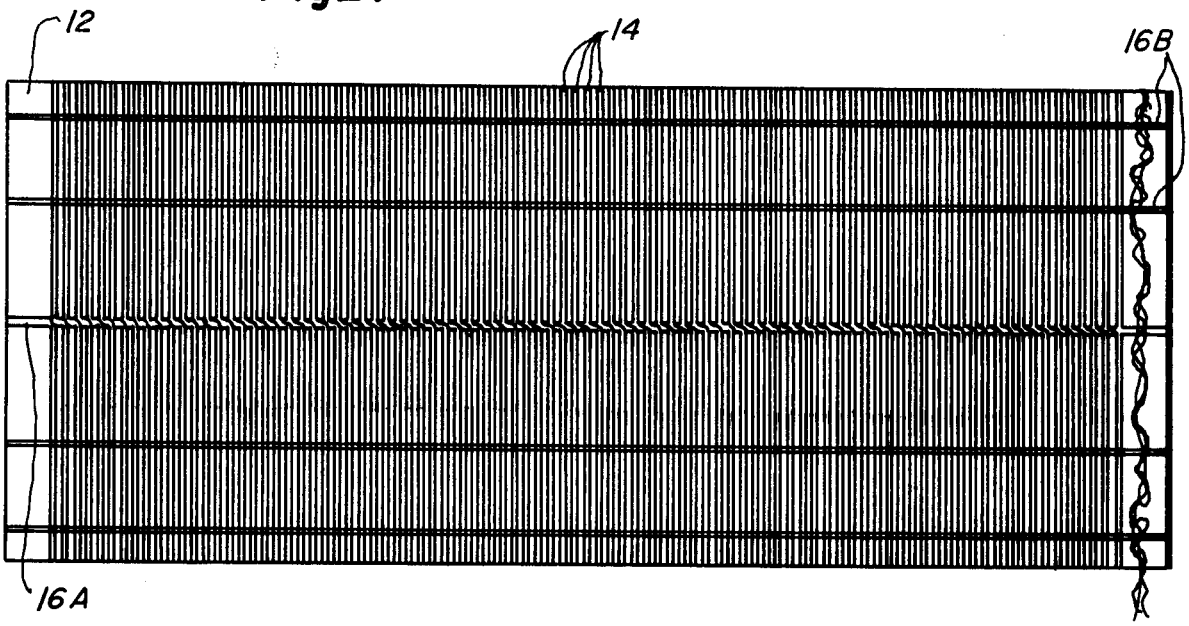
FIG. 1 is a side view of an illustrative embodiment of the coil structure in accordance with the invention.

Referring more particularly to the drawings, FIG. 1 shows a coil form 12 which is hollow and which is approximately 10 inches long and 4 inches in outer diameter. It is generally cylindrical in form. The wall thickness of the cylindrical form is approximately 0.150 inch.

The outer surface of the cylindrical form 12 is provided with a large number of circular grooves 14, and twelve longitudinally extending grooves 16A and 16B. These peripheral and longitudinal grooves have fine insulated conducting wires wound in them to form magnetic fields coaxial with the core and transverse thereto, as will be described in greater detail below.

Figure 2:
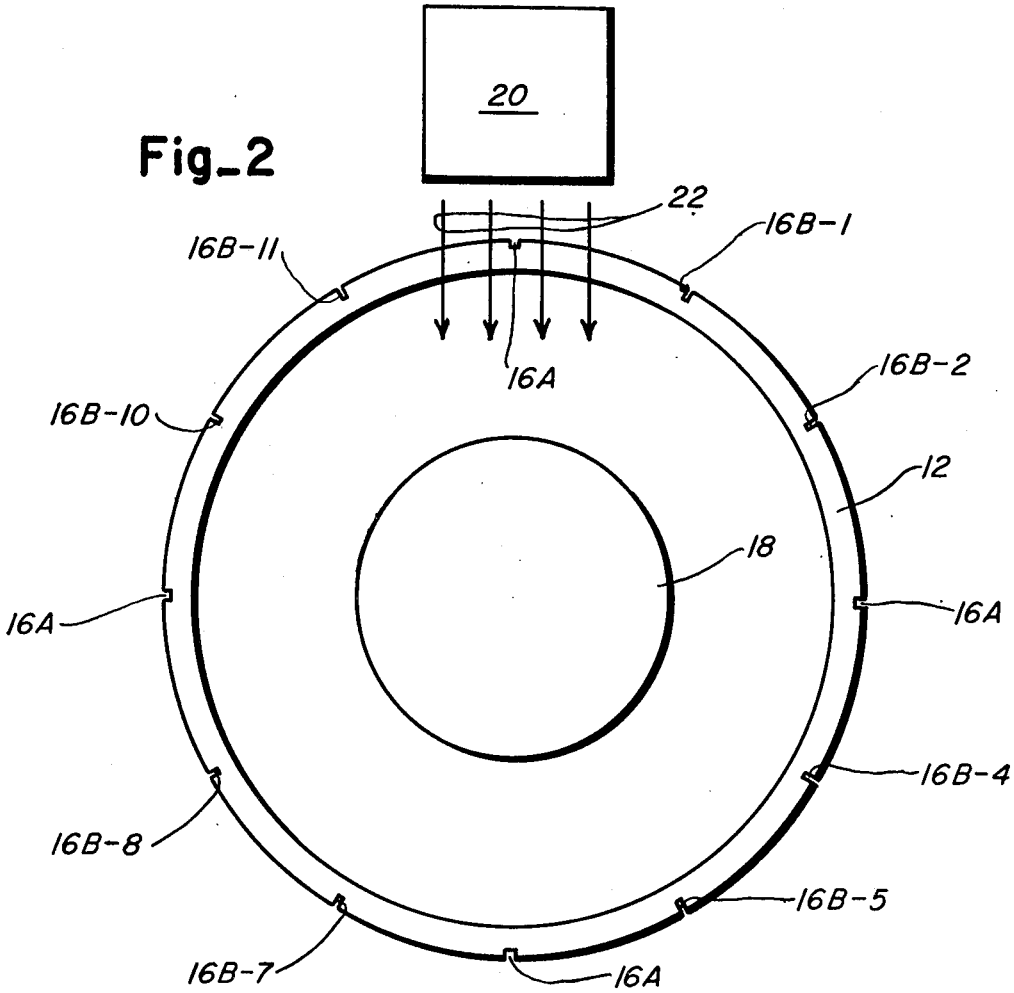
FIG. 2 is an end view of the coil form, also showing a source of illumination and a nuclear magnetic resonance cell.

FIG. 2 is an end view of the coil form 12 in diagrammatic form and also it shows schematically a magnetic field responsive cell 18 and a source of radiation 20 which may direct illumination or light 22 as indicated by the arrows through the coil form 12, which may be transparent, and onto the cell 18.

Incidentally, reference is hereby made to U.S. Pat. application Ser. No. 714,978 filed Aug. 16, 1976, entitled "Nuclear Magnetic Resonance Gyro," inventor - Bruce C. Grover et. al. The coil form disclosed in the present patent application may be employed in apparatus such as that described in the abovecited patent application to provide coupling with the nuclear magnetic resonance cell which is located as indicated by the reference numeral 18 in FIG. 2 of the present drawings.

As mentioned above, there are a number of longitudinal grooves 16A and 16B spaced around the periphery of the coil form 12. As will be noted below in connection with FIGS. 4 and 5, the grooves 16A are relatively broad, while the grooves 16B are somewhat narrower. As may be seen from FIG. 2, there are 12 grooves spaced around the periphery of the coil form in positions somewhat similar to the numbers on a clock. Using this analogy, the broader grooves 16A appear at 3, 6, 9 and 12 o'clock positions, and the narrower grooves 16B appear at positions on the coil form corresponding to hours 1, 2, 4, 5, 7, 8, 10 and 11.

FIG. 3 is a detail showing the configuration of the peripheral grooves 14 thich extend around the coil form 12. As mentioned above, the coil form 12 is approximately 0.150 of an inch in thickness. The grooves 14 are approximately 0.012 inch deep, and have approximately the same width. Within the grooves 14 are fine copper wires 22. They are No. 30 wire, having a diameter of the copper conductor equal to 0.10 inch, and they have an insulating layer approximately 0.0005 inch thick. This makes the total diameter of the insulated copper wires 22 about 0.011 inch. FIGS. 4 and 5 are cross-sectional views through one of the grooves 16B and one of the grooves 16A, respectively. These longitudinal grooves 16A and 16B are both approximately 0.030 inch deep. The grooves in 16B as shown in FIG. 4 are only 0.012 inch wide, while the longitudinal grooves 16A as shown in FIG. 5 are 0.030 inch wide. The depth of the longitudinal grooves 16A and 16B is substantially more than that of the peripheral grooves 14. This permits the prior insertion of longitudinal wires in grooves 16A and 16B, and subsequent winding of the coil in the peripheral grooves 14 without interference or deformation of the leads as a result of undue protrusion of the leads in longitudinal grooves 16.

As mentioned above, it is desired to obtain weak magnetic coupling perpendicular to the axis of the coil form 12. In order to produce a weak magnetic coupling to the cell 18 (FIG. 2) parallel to lines 22, a first coil is formed using a wire extending along longitudinal groove 16B-2 and back along longitudinal groove 16B-10. In the foregoing designation, the longitudinal groove 16B-2 is a narrow 16B type longitudinal groove located at position No. 2 as indicated by the analogy to a clock face. Similarly, 16B-10 is a narrow 16B type longitudinal groove located at hour position 10. A second coil using wires in slots 16B-4 and 16B-8 provides magnetic coupling which reinforces that of the previously mentioned coil. When a magnetic field is to be applied vertically as shown in FIG. 2, therefore, the upper and lower coils as mentioned above are energized to provide reinforcing magnetic fields at the center of the coil form 12 in the vicinity of cell 18.

Another pair of coils including a first coil utilizing grooves 16B-7 and 16B-11, together with peripheral groove interconnections; and a second coil including wires extending down longitudinal grooves 16B-1 and 16B-5 serves to reinforce the magnetic coupling along the horizontal, as shown in FIG. 2. Accordingly, the structure as described hereinabove provides a relatively strong magnetic field along the axis of the coil form 12, and two relatively weak coupling arrangements to provide three mutually orthogonal magnetic fields or magnetic field coupling circuits.

FIG. 6 is a detailed showing of one of the grooves 16A where it crosses a series of peripheral grooves 14. In this simplified showing of FIG. 6, the circular nature of the grooves 14 is clearly shown. Instead of having helical grooves which would permit the easy interconnection of one turn with the next adjacent turn and no real transition point, the arrangement of the present illustrative embodiment of the invention shows peripheral grooves 14 which are truly circular and wherein the adjacent turns are interconnected at the groove 16A. More particularly the insulated copper wire 26 is bent at the area 28 and proceeds to the next adjacent peripheral groove as designated by section 30 of the wire. Similarly, section 30 after completing a circumferential transit of the coil form 12 in one of the grooves 14 has a bend at section 32 and continues as wire section 34 in the next adjacent peripheral groove 14.

As a minor additional point, it may be noted that the various sections 28, 32, etc. in the wide groove 16A have a longitudinal current component which, if not cancelled out, would create an undesired transverse component of magnetic field within the coil form 12. Accordingly, with reference to FIGS. 1 and 7, before or after the winding of the coil in grooves 14, an additional lead for carrying current flowing in the opposite direction is laid along the full length of the wide groove 16A shown in FIG. 6, thereby providing an exact cancellation of the magnetic field produced by the wire segments 28, 32, etc.

FIG. 7 is a diagram employed in analyzing the magnetic field produced by coils made up of longitudinal wires such as those discussed above located in the grooves 16B. More specifically, in FIG. 7 a four conductor configuration is considered and the resulting magnetic field is analyzed for uniformity at the origin point 0, which would correspond to the center of the coil form 12, in FIGS. 1 and 2. In FIG. 7 the two upper conductors are shown carrying current in one direction as indicated by the plus signs and the two lower conductors are carrying the current in the opposite direction as indicated by the minus signs. This would correspond generally to the arrangement described above for producing a horizontal magnetic field using one coil including wires in grooves 16B-7 and 16B-11, and another coil including wires in grooves 16B-1 and 16B-5. Expressed mathematically this appears as follows:

$$I_1(+) \text{ at } (a, b)$$
$$I_2(+) \text{ at } (-a, b) \qquad (1)$$
$$I_3(-) \text{ at } (-a, -b)$$
$$I_4(-) \text{ at } (a, -b)$$

Now, considering the magnetic field at a point X, along the X-axis the following expression obtains:

$$\Sigma H_x = 2I\left[\frac{(y-b)}{(x-a)^2+(y-b)^2} + \frac{(y-b)}{(x+a)^2+(y-b)^2} - \frac{(y+b)}{(x+a)^2+(y+b)^2} - \frac{(y+b)}{(x-a)^2+(y+b)^2}\right] \qquad (2)$$

Now, as we are principally interested in the magnetic field through the center of the two coils which are formed, we will set $y = 0$ and thus confine our attention to that along the $x$ axis. Setting $y = 0$ then expression (2) is equal to the following:

$$\Sigma H_x(x, o) = 4Ib\,[((x-a)^2 + b^2)^{-1} + ((x+a)^2 + b^2)^{-1}] \qquad (3)$$

Now, taking the second derivative of the magnetic field $H_x$ with respect to X, then setting $X = 0$ to indicate that we are primarily interested in a situation where the second derivative or the change in slope is 0 and solving the equation we find that the relationship between b and a is as follows:

$$b = \sqrt{3a} \qquad (4)$$

Of course, the relationship set forth at (4) above defines a 30° angle and this is the relationship of the coils extending longitudinally in groove 16B-7 and 16B-11, together with the coil extending in one direction along groove 16B-1 and back along 16B-5. These longitudinal grooves and the coils located in them are therefore arranged to provide a magnetic field in which not only the slope of the magnetic field along the direction of the magnetic field is 0, but where the second derivative or the inflection point of the magnetic field characteristic is also equal to 0. Accordingly, the coils are optimally located.

In conclusion, it is clear that the disclosed embodiment is uniquely adapted to provide a strong axial magnetic field as well as mutually orthogonal weaker fields. It is also clear that departures from the precise construction shown could be employed. Thus, for example, instead of having the longitudinal grooves deeper than the peripheral grooves, the reverse could be employed to avoid interference. In addition, instead of a cylindrical form, a pair of matched cones or a spheroid or sphere could be used, or other simple figures of revolution with an outer grooved surface could be employed. Further, the grooves for the transverse field coils could be curved rather than longitudinal, if desired. It is also noted that a lesser number of longitudinal grooves could be used. Thus, for example, with only four grooves, all of the four coils for the weak vertical and the weak horizontal fields could be located in these grooves, and the transition segments 28, 32, etc. could also be located in one of them.

I claim:

1. In a coil structure for applying a strong magnetic field in a predetermined direction, and weaker magnetic field in two additional mutually orthogonal directions:

a generally cylindrical coil form, said coil form having a plurality of peripheral grooves along its length, and a plurality of longitudinal grooves extending parallel to the axis of said form along the outer surface of said form;

first coil means including wires wound in said peripheral grooves for providing strong magnetic coupling along the axis of said coil form;

second coil means including a wire extending down at least one of said longitudinal grooves and back in another of said longitudinal grooves for providing weak magnetic coupling in a first transverse direction perpendicular to the axis of said coil form, and third coil means including a wire extending down one of said longitudinal grooves and back in another for providing weak magnetic coupling perpendicular the axis of said coil form, and at an angle with respect to said first transverse direction.

2. A coil structure as defined in claim 1 wherein said third coil means provides magnetic coupling at an angle of 90° with respect to said first transverse direction.

3. A structure as defined in claim 1 further including magnetic field responsive material located within said coil form.

4. A coil structure as defined in claim 1 wherein each of said peripheral grooves constitutes a closed circle perpendicular to said axis, and wherein said first coil means is formed by wires wound in successive peripheral grooves with successive turns of said first coil means being interconnected by short sections of said wires extending along one of said longitudinal grooves between adjacent peripheral grooves.

5. A coil structure as defined in claim 1 wherein said peripheral grooves constitute a first set of grooves and said longitudinal grooves constitute a second set of grooves, and wherein one of said sets of grooves is of greater depth than the other, whereby the coil means wound in the deeper grooves may be put in place first without interference to the smooth location of the coil means in the shallower grooves.

6. A coil structure as defined in claim 1 wherein said coil form is made of an insulating plastic material.

7. A coil structure as defined in claim 1 wherein said coil form is made of a transparent material.

8. A coil structure as defined in claim 2 wherein said second and third coil means each include at least two coils located on opposite sides of said axis, and with each of the four coils included in said second and third coil means including a section of wire in one longitudinal groove and another section of wire in a spaced longitudinal groove.

9. In a coil structure for obtaining strong magnetic coupling with a region in a predetermined direction, and weaker magnetic coupling to said region in another direction:

a coil form having the form of a surface of revolution about a longitudinal axis, said coil form having a plurality of peripheral grooves around said axis along the length of said form, first coil means including wires wound in said peripheral grooves for providing strong magnetic coupling along said axis of said coil form;

second coil means for providing weak magnetic coupling in a direction transverse to the said axis of said coil form; and means including an plurality of longitudinal grooves in the outer surface of said form and intersecting said peripheral grooves supporting said second coil means.

10. A coil structure as defined in claim 9 further comprising:

third coil means including wire sections extending down one of said longitudinal grooves and back in another of said longitudinal grooves for providing weak magnetic coupling in a different direction transverse to the axis of said coil form.

11. A coil structure as defined in claim 9 wherein said second coil means includes first and second pairs of coils for establishing mutually orthogonal transverse magnetic coupling.

12. A coil structure as defined in claim 9 wherein said plurality of longitudinal grooves each lie substantially in a plane passing through said axis.

13. A coil structure as defined in claim 9 wherein said longitudinal grooves are of different depth than said peripheral grooves to avoid interference.

* * * * *